United States Patent [19]

Smallegan

[11] Patent Number: 4,682,802

[45] Date of Patent: Jul. 28, 1987

[54] LOCK MECHANISM AND A SPRING AND CAM ASSEMBLY THEREFOR

[75] Inventor: Jon M. Smallegan, San Mateo, Calif.

[73] Assignee: Schlage Lock Company, San Francisco, Calif.

[21] Appl. No.: 785,987

[22] Filed: Oct. 10, 1985

[51] Int. Cl.[4] ..... E05B 9/04

[52] U.S. Cl. ..... 292/337; 292/169.21

[58] Field of Search ..... 292/337, 169.21

[56] References Cited

U.S. PATENT DOCUMENTS

| | | | |
|---|---|---|---|
| 2,649,325 | 8/1953 | Heyer | 292/337 |
| 2,664,306 | 12/1953 | Cerf, Jr. | 292/337 |
| 2,726,891 | 12/1955 | Gresham et al. | 292/337 |
| 2,795,948 | 6/1957 | Rayburn | 292/337 |
| 2,885,880 | 5/1959 | Muttart | 292/337 |
| 3,128,115 | 4/1964 | Patriguin et al. | 292/337 |
| 3,279,836 | 10/1966 | Swanson | 292/337 |

FOREIGN PATENT DOCUMENTS

| | | | |
|---|---|---|---|
| 579527 | of 0000 | Canada | 292/337 |

*Primary Examiner*—William F. Pate, III
*Assistant Examiner*—Michael Safavi
*Attorney, Agent, or Firm*—W. C. Vliet; B. J. Murphy

[57] ABSTRACT

The lock mechanism has a spring and cam assembly provided for returning the lock plunger assembly of the mechanism from a locked to an unlocked position thereof. In addition, however, the spring and cam assembly carries an enlongated limb. When the lock plunger assembly is translated to a locked position, it forces the limb to extend from the spring and cam assembly to a disposition in which it blocks a knob catch which is carried in the outside spindle of the mechanism. Accordingly, for being blocked by the limb, the knob catch cannot be depressed and, consequently, the knob which is latchingly engaged by the catch, cannot be removed from the outside spindle whenever the mechanism is in its locked disposition. The spring and cam assembly comprises a compact unit which is slidably received in the outside spindle and confiningly supports the limb therewithin for extension therefrom into obstruction of the knob catch.

8 Claims, 3 Drawing Figures

FIG. 1
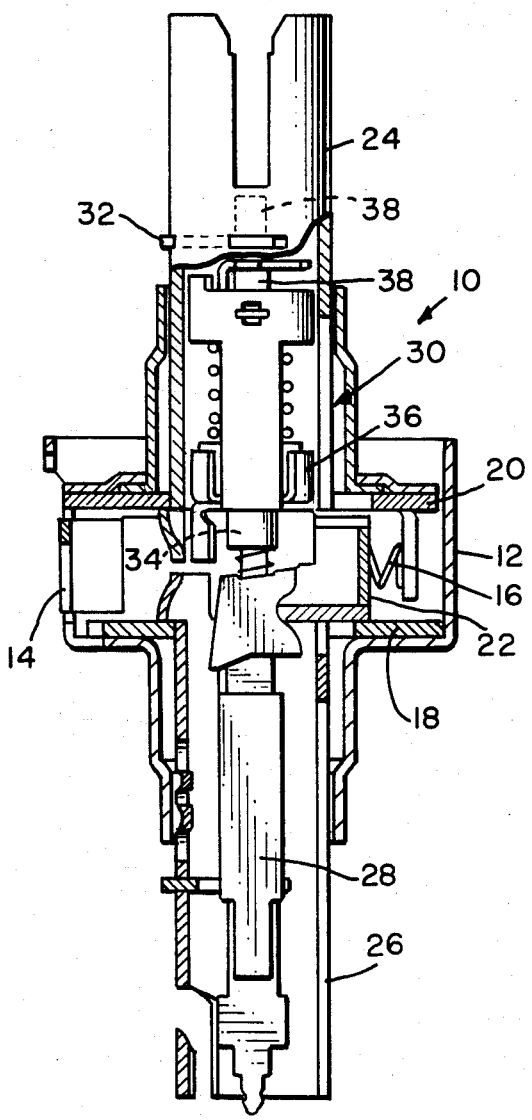
FIG. 2
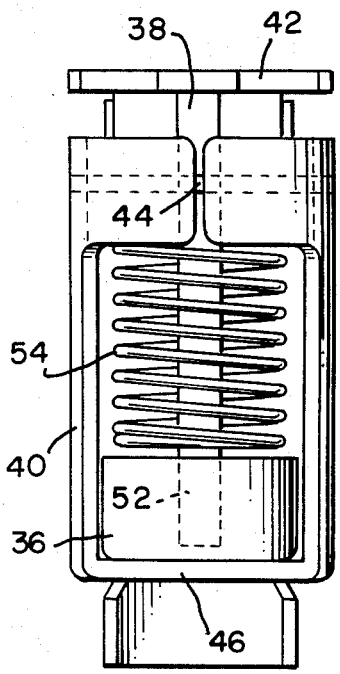
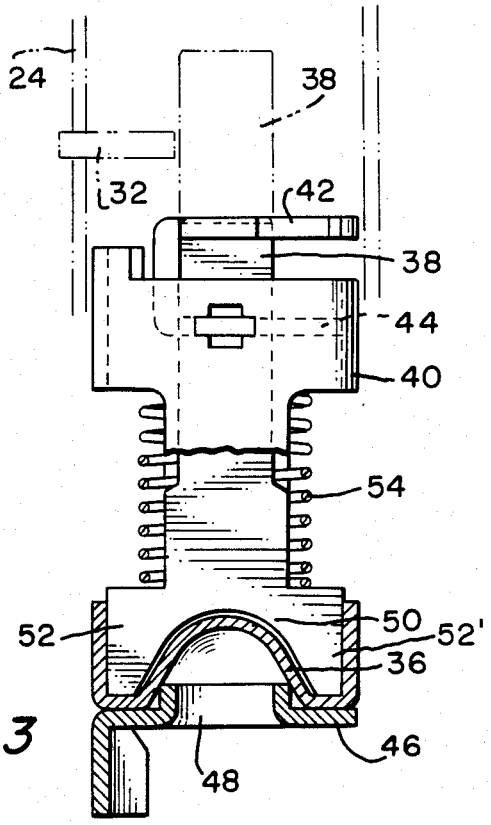
FIG. 3

LOCK MECHANISM AND A SPRING AND CAM ASSEMBLY THEREFOR

This invention pertains to lock mechanisms, and spring and cam assemblies therefor, for example, to such mechanisms having spindles with knob catches therein for lockingly engaging slotted door knobs, and in particular to a novel mechanism of the aforesaid type in which the knob catch of the outside spindle of the mechanism can be obstructed, to prevent removal of the door knob therefrom, by means carried in the spring and cam assembly of the mechanism, and especially the invention pertains to the spring and cam assembly which incorporates such obstructing means.

In prior art lock mechanisms, it has been necessary to clinch the unslotted, outside door knob to the outside spindle, securely, so that the knob cannot be removed to allow access to and tampering with, the inner lock components of the mechanism. However, in that it cannot always be known what sort of trim is to be used with a given lock mechanism, such mechanisms can only be partially assembled, in manufacturing operations, until it is determined what trim is to be incorporated. Then, with the selected trim assembled to the mechanism, and as one of the final operations of preparation, the unslotted, outside knob can be clinched onto the outside spindle.

It would be much simpler if it were possible to use slotted knobs on the outside spindle, the same as on inside spindles. Then, whatever is to be the trim, it will be easy to remove the slotted, "catched" knob from the outside spindle to accommodate any selected trim. However, as noted, slotted knobs on the outside of a lock mechanism invite vandalism or intrusion in that it is simple to depress the knob catch, remove the knob, and then violate the internal lock components.

It is an object of this invention to set forth a lock mechanism which accommodates slotted knobs on the outside spindle which, nonetheless, provides for security in that the knob catch is prevented from retracting when the lock mechanism is in its locked disposition.

It is also an object of this invention to set forth a lock mechanism comprising; (a) inside and outside spindles; (b) a lock plunger assembly movably disposed within said inside spindle between locked and unlocked dispositions thereof; (c) a spring and cam assembly within said outside spindle for moving said lock plunger assembly from said locked to said unlocked disposition; (d) a knob catch coupled to said outside spindle, and retractable thereinto, for releasably latching a knob to said outside spindle; and means disposed within said outside spindle for obstructing said catch to prevent retraction thereof; wherein said obstructing means is movably disposed, within said outside spindle, between a first positioning thereof in which it is obstructively in traverse of said knob catch to prevent retraction of the latter, and a second positioning thereof in which it is displaced from said knob catch; and said assemblies comprise means cooperative for moving said obstructing means from one of said first and second positionings to the other thereof.

It is another object of this invention to disclose a novel spring and cam assembly, for a lock mechanism, comprising; a dual-ended frame; said frame having a first end plate at one end thereof; said end plate having a first opening formed therein; said frame further having a wall therewithin, parallel with said end plate and adjacent to said one end, with a second opening formed therein; and a limb confined within said frame; wherein said limb has a given end thereof slidably engaged with said first and second openings; further including a cap slidably disposed within said frame; said frame further having a second end plate at the opposite end thereof; said limb further having a base at the opposite end thereof nestably engaged with said cap; and a compression spring, interposed between said wall and said base, resiliently holding said base against said cap and the latter against said second end plate.

Further objects of this invention as well as the novel features thereof, will become more apparent by reference to the following description taken in conjunction with the accompanying figures in which;

FIG. 1 is a partially cross-sectioned view of a lock mechanism according to a embodiment of the invention representing the best mode of its construction known to the inventor, the view having been taken along the logitudinal axis of the mechanism.

FIG. 2 is a elevational view of the novel spring and cam assembly which is incorporated in the mechanism of FIG. 1.

FIG. 3 is a side elevation of the spring and cam assembly again, taken from the left side of FIG. 2, with a portion thereof being cut away for purposes of clarity.

As shown in the Figures, the lock mechanism 10 comprises a housing assembly 12 confining therewithin a lock slide 14, slide springs 16, plates 18 and 20, spring seat 22, etc., as is conventional in prior art lock mechanisms. Mounted to the housing assembly 12 are an outside spindle 24 and a inside spindle 26. The latter has disposed therewithin a lock plunger assembly 28. The outside spindle 24 confines a spring and cam assembly 30, and a knob catch 32 for latching (to the spindle) a slotted knob (not shown). The lock plunger assembly 28 terminates, inwardly, in a nose 34 which is used to displace a cap 36 in the spring and cam assembly 30 and, as a consequence thereof, translate a limb 38 to block retraction of the knob catch 32.

The spring and cam assembly 30 is shown considerably enlarged and in greater detail in FIGS. 2 and 3. It comprises a generally open frame 40 and has a first, apertured plate 42 at one end, and adjacent thereto an apertured, parallel wall 44. The other end of the frame 40 has a second end plate 46 with a hole 48 in the center thereof through which to accommodate the nose 34 of the lock plunger assembly 28.

The limb 38 has a narrow end which is slidably engaged with the apertures in the first end plate 42 and the wall 44, and has a base 50 formed of laterally-extending portions 52 and 52' which receive one end of a compression spring 54. The other end of the spring is set against the wall 44. The base of the limb 38 is nested in the cap 36, and the latter is resiliently held against the second end plate 46.

When the lock plunger assembly 28 is translated into a locking attitude, it is displaced upwardly (with reference to FIG. 1). The nose 34 passes through the hole 48 in the second end plate 46, and pushes the cap 36 upwardly therefrom. Coincidentally, then, the limb 38 is likewise displaced and moves to the disposition shown in phantom in FIGS. 1 and 3. In this attitude, the limb 38 obstructs the knob catch 32 to prevent its retraction into the outside spindle 24. Consequently, with a slotted knob assembled onto the outside spindle 24, and its slot engaged with the knob catch 32, it is impossible to remove such a knob all the while the mechanism 10 is in the locked position.

By this novel arrangement, it is now possible to assemble lock mechanisms, substantially entirely, without knowing beforehand the type of trim to be used therewith. This is so because a slotted, readily removable knob can be used on the outside spindle with no risk of compromise of the lock mechanism. As will be appreciated, the novel limb 38 of the spring and cam assembly 30 effectively prevents displacement of the knob catch 32, and removal of the knob—which would otherwise give access to the lock mechanism—while the mechanism is locked by the lock plunger assembly 28.

While I have described my invention in connection with a specific embodiment thereof, it is to be clearly understood that this is done only by way of example, and not as a limitation to the scope of my invention as set forth in the objects thereof and in the appended claims.

I claim:

1. A lock mechanism comprising:

(a) inside and outside spindles;

(b) a lock plunger assembly movably disposed within said inside spindle between locked and unlocked dispositions thereof;

(c) a spring and cam assembly within said outside spindle for moving said lock plunger assembly from said locked to said unlocked disposition;

(d) a knob catch coupled to said outside spindle, and retractable thereinto, for releasably latching a knob to said outside spindle;

and means disposed within said outside spindle for obstructing said catch to prevent retraction thereof;

wherein said obstructing means is movably disposed, within said outside spindle, between a first positioning thereof in which it is obstructively in traverse of said knob catch to prevent retraction of the latter, and a second positioning thereof in which it is displaced from said knob catch; and said assemblies comprise means cooperative for moving said obstructing means from one of said first and second positionings to the other thereof.

2. A lock mechanism, according to claim 1, wherein:

said outside spindle has an aperture formed therein;

said catch comprises a tab, mounted within said outside spindle, in projecting penetration of said aperture; and said obstructing means comprises a limb movable within said outside spindle, as aforesaid, into adjacency with said tab to prohibit retraction of said tab.

3. A lock mechanism, according to claim 2, wherein:

said outside spindle has a longitudinal axis;

said tab is resiliently movable substantially normal to, and at a location intermediate the length of, said axis; and said limb is movable, parallel with said axis, into and away from said location.

4. A lock mechanism, according to claim 2, wherein:

said spring and cam assembly confines said limb therewithin.

5. A lock mechanism, according to claim 2, wherein:

said spring and cam assembly comprises a dual-ended frame;

said frame having a first end plate at one end thereof;

said end plate having a first opening formed therein;

said frame further having a wall therewithin, parallel with said end plate and adjacent to said one end, with a second opening formed therein;

said limb having a given end thereof slidably engaged with said first and second openings; further including a cap slidably disposed within said frame;

said frame further having a second end plate, with a hole formed therein, at an opposite end thereof which is opposite said one end;

said limb further having a base at the opposite end thereof nestably engaged with said cap; and a compression spring, interposed between sald wall and said base, resiliently holding said base against said cap and the latter against said second end plate.

6. A lock mechanism, according to claim 4 wherein:

said lock plunger assembly comprises means for (a) penetrating said spring and cam assembly, and (b) moving said limb, confined therewithin, into said adjacency to said tab.

7. A lock mechanism, according to claim 5, wherein:

said lock plunger assembly comprises a nose which, upon movement of said lock plunger assembly to said locked disposition, enters said hole in said second end plate and displaces said cap and said base from said second end plate.

8. A lock mechanism, according to claim 7, wherein:

said nose of said plunger assembly comprises means for displacing said limb, relative to said frame, and forcing said given end of said limb to project, extendably, from said frame.

* * * * *